US006588343B1

(12) United States Patent
Mulinix

(10) Patent No.: US 6,588,343 B1
(45) Date of Patent: Jul. 8, 2003

(54) IGNITER SYSTEM FOR A FLARE

(75) Inventor: David J. Mulinix, Bloomington, IN (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 10/263,282

(22) Filed: Sep. 26, 2002

(51) Int. Cl.[7] ..... F42C 15/18; F42C 15/34

(52) U.S. Cl. ..... 102/256; 102/229; 102/230; 102/254

(58) Field of Search ..... 102/229, 230, 102/254, 256

(56) References Cited

U.S. PATENT DOCUMENTS

| | | | | | |
|---|---|---|---|---|---|
| 3,392,672 | A | | 7/1968 | Noles | 102/70 |
| 3,423,931 | A | | 1/1969 | Schwarz et al. | 60/39.47 |
| 3,529,418 | A | | 9/1970 | Puckett et al. | 60/39.09 |
| 4,029,014 | A | | 6/1977 | Cunningham | 102/35 |
| 4,147,493 | A | | 4/1979 | Straitz | 431/15 |
| 4,307,665 | A | | 12/1981 | Block et al. | 102/505 |
| 4,406,227 | A | | 9/1983 | Beeker et al. | 102/505 |
| 4,573,411 | A | | 3/1986 | Liebhardt et al. | 102/256 |
| 4,599,945 | A | | 7/1986 | Groustra et al. | 102/256 |
| 4,683,823 | A | | 8/1987 | Dinger et al. | 102/229 |
| H453 | H | | 4/1988 | Schmidlin | 102/221 |
| 4,986,184 | A | * | 1/1991 | Kude | 102/256 |
| 4,998,476 | A | * | 3/1991 | Rudenauer et al. | 102/226 |
| 5,033,383 | A | | 7/1991 | Edminster | 102/254 |
| 5,063,847 | A | | 11/1991 | Halssig et al. | 102/271 |
| 5,561,259 | A | | 10/1996 | Herbage et al. | 102/334 |
| H1603 | H | | 11/1996 | Deckard et al. | 102/336 |
| 5,763,818 | A | * | 6/1998 | Guymon et al. | 102/336 |
| 5,801,321 | A | | 9/1998 | LaGrange et al. | 102/336 |
| 6,389,976 | B1 | * | 5/2002 | Zacharin | 102/259 |
| 6,412,417 | B1 | * | 7/2002 | Anderson et al. | 102/337 |

* cited by examiner

*Primary Examiner*—Peter A. Nelson
(74) *Attorney, Agent, or Firm*—Mark O. Glut

(57) ABSTRACT

An igniter system for a flare that includes a housing, a slider assembly, and a piston assembly. The housing includes two ignition portals for holding ignition pellets. The slider assembly is disposed within the housing, and includes two sliders and a spring. Each slider corresponds to an ignition portal, and the two sliders communicate with the spring. The slider assembly has an armed position and a safe position, the armed position with the sliders uncovering the ignition portals and allowing conflagrant communication between the ignition pellets and flare grain, while the safe position with the sliders covering the ignition portal and not allowing conflagrant communication between the ignition pellets and flare grain. The piston assembly communicates with the housing. The piston assembly, when activated, can cause the slider assembly to be in the armed position.

16 Claims, 4 Drawing Sheets

IGNITER SYSTEM FOR A FLARE

STATEMENT OF GOVERNMENT INTEREST

The invention described herein may be manufactured and used by or for the Government of the United States of America for governmental purposes without payment of any royalties thereon or therefor.

BACKGROUND

The present invention relates to an igniter system for a flare. More specifically, but without limitation, the present invention relates to an igniter system for an aerial flare.

Aerial flares are used for a variety of applications, including, but not limited to, illumination, signaling, marking, decoys, military countermeasures, and the like. A flare is typically defined, but without limitation, as a pyrotechnic device designed to produce illumination or a luminous signal. Due to the important nature of their uses, aerial flares require a high degree of reliability in their ignition systems. The flare must not prematurely ignite, which can cause damage to the platform from which the flare is being released (a platform can be, for instance, but without limitation, a stand, an aircraft, a ship, a submarine, a land vehicle, or the like.) The flare must also have consistent ejection velocities.

The flare and its igniter must be in a constant state of readiness, and when the flare ignition system is placed in the "armed" mode, ignition must be certain. Nevertheless, the flare cannot be carried on a vehicle/aircraft or transported in an armed mode at all times. The flare must be capable of being transported with the ignition in a "safe" mode in which ignition is impossible.

In operation, typically a military flare or countermeasure is dispensed from a flare dispenser using an impulse cartridge. Upon initiation of the impulse cartridge, the internal payload (the igniter system) begins to exit from the case. The hot particles from the impulse cartridge travel through a hole and ignite an ignition pellet. An interrupt or slider separates the pellet and flare grain (i.e. the illuminant or pyrotechnic material.) As the ignition system departs from the flare case the interrupt or slider is removed from between the ignition pellet and flare grain, allowing the flare grain to be ignited by the pellet, and thus illuminating the flare.

Despite the various safe and armed igniter designs in use, premature ignitions continue to happen. The cause of most of these premature ignitions is hot gases from the impulse cartridge around the flare piston and igniter, which directly ignite the flare grain, pyrotechnic material or illuminant. Besides the chance of premature ignition, blow of impulse cartridge gases causes a reduction in the flare grain exit velocity. Many flare igniters do not adequately center the payload/igniter to prevent impulse cartridge gas blow around the piston, which can cause a premature ignition or reduction in flare velocity. This is especially important in military applications, such as countermeasures or decoys, because in today's combat environment, some missiles use forward motion of an aircraft to discriminate between the signature of an aircraft and the signature of a decoy flare or countermeasure. Therefore, to be an effective countermeasure or decoy, the flare must be capable of keeping up with the speed of the aircraft, thus any reduction of flare velocity or a premature ignition would render a countermeasure or decoy ineffective against these types of missiles.

Certain igniters also have a tendency to ignite the flare grain prior to exiting the flare dispenser and/or prior to exiting the case (a type of premature ignition). This could cause damage to the dispenser and the platform.

Information relevant to address these problems can be found in U.S. Pat. No. 5,561,259 and U.S. Statutory Invention Registration Number H1603. However, each of these references, as well as other uncited references, suffers from one or more of the following disadvantages: the igniter does not adequately center the payload or igniter to prevent impulse cartridge gas blow by around the piston; at times the igniter causes unwanted premature grain ignitions; and causes inconsistent ejection velocity of the grain.

For the foregoing reasons, there is a need for an igniter system for a flare.

SUMMARY

The instant invention is directed to an igniter system for a flare that satisfies the needs enumerated above and below.

The present invention is directed to an igniter system for a flare that includes a housing, a slider assembly, and a piston assembly. The housing has two ignition portals for holding ignition pellets. The slider assembly is disposed within the housing, and includes two sliders and a spring. Each slider corresponds to an ignition portal, and the two sliders communicate with the spring. The slider assembly has an armed position and a safe position. The armed position has the sliders not covering the ignition portals and allowing conflagrant communication between the ignition pellets and flare grain, while the safe position has the sliders covering the ignition portals and not allowing conflagrant communication between the ignition pellets and flare grain. The piston assembly communicates with the housing and communicates with the inside of the flare case to contain gases generated by the impulse cartridge. This provides the pressure needed to eject the igniter/grain assembly from the flare case. Upon exiting the case, the slider assembly moves to armed position. The ignition pellets, ignited by hot particles from the impulse cartridge, communicate with the grain through the ignition portals to ignite the flare grain.

It is an object of the invention to provide an igniter system for a flare that prevents and minimizes premature ignition of a flare and substantially assures that the flare grain is completely exited from their outer case before ignition.

It is an object of the invention to provide an igniter system for a flare that ensures rapid reliable ignition as soon as the flare grain exits the flare case.

It is an object of the invention to provide an igniter system for a flare that adequately centers the payload/igniter to prevent impulse cartridge gas blow by around the piston.

It is an object of the invention to provide an igniter system for a flare that has consistent ejection velocities, and can be effectively used in flares that act as countermeasures or decoys.

It is an object of the invention to provide an igniter system for a flare that is efficient, simple and an inexpensive safe-arm device for a flare.

It is an object of the invention to provide an igniter system for a flare that does not ignite flare grain prior to exiting the flare dispenser and the flare case.

DRAWINGS

These and other features, aspects and advantages of the present invention will become better understood with reference to the following description and appended claims, and accompanying drawings wherein:

DESCRIPTION

Figure 1:
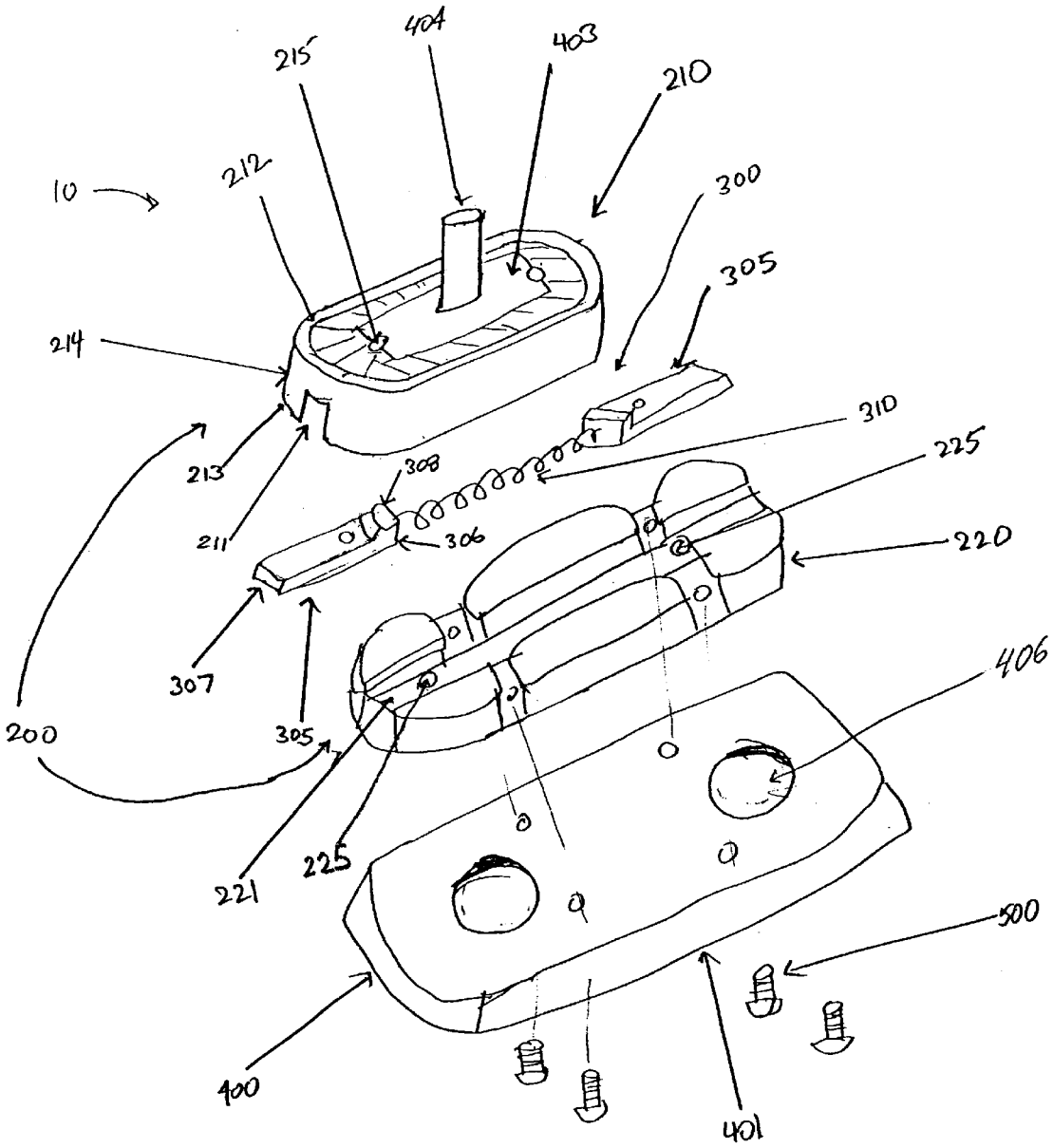
FIG. 1 is an exploded top view of one of the embodiments of the igniter system for a flare.
Figure 2:
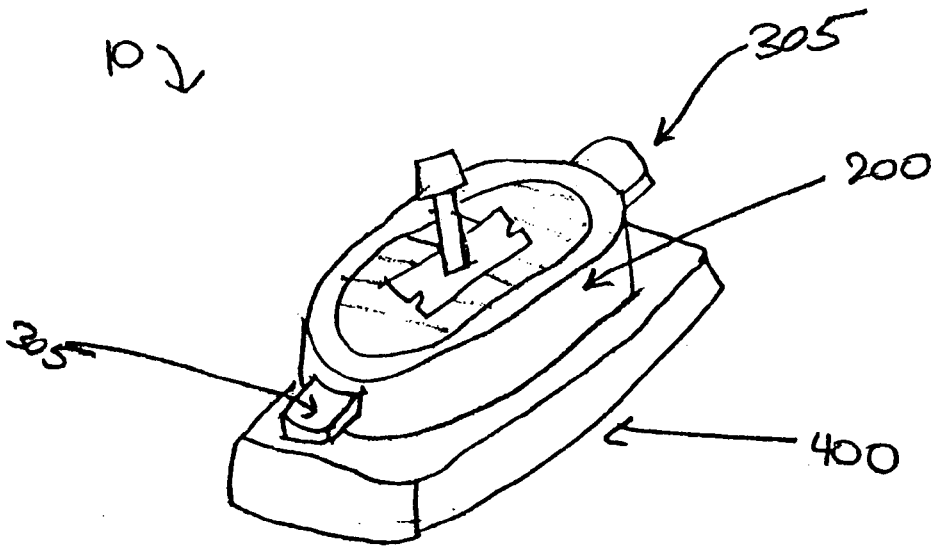
FIG. 2 is a top view of one of the embodiments of the igniter system for a flare.
Figure 3:
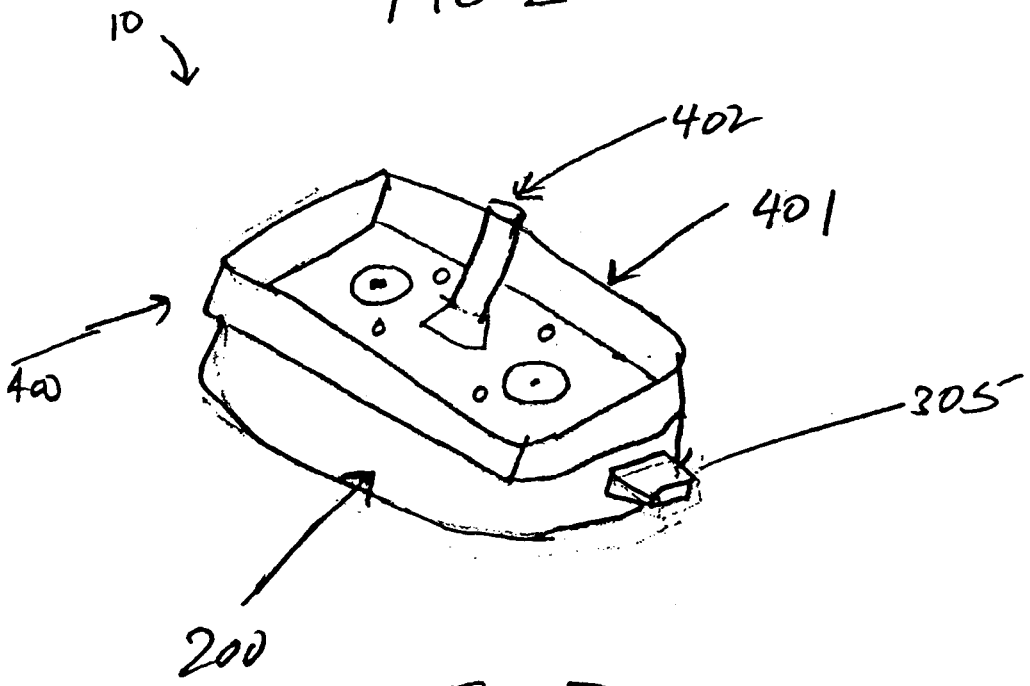
FIG. 3 is a bottom view of one of the embodiments of the igniter system for a flare.

The preferred embodiment of the present invention is illustrated by way of example below and in FIGS. 1, 2, 3, 4, and 5. As seen in FIGS. 1–4, the igniter system for a flare 10 includes a housing 200, a slider assembly 300, and a piston assembly 400.

The housing 200 may have a first portion 210 and a second portion 220. The second portion 220 may have an ignition portal 225 for holding an ignition device. An ignition portal 225 may be, but without limitation, an entrance, an aperture, a cavity, a chamber, a passage, an embrasure, a groove, a filister, a foramen, a notch, a gain, a rabbet, a sulcus, a furrow, a cup, a holder, or any device that can accept or hold an ignition device. The ignition device may be, but without limitation, an ignition pellet 230, an incendiary device, or any type of device that can ignite a flare 500. Typically the ignition device or ignition pellets 230 are designed to ignite from hot impulse cartridge gases emanating from an activated impulse cartridge 505.

The preferred embodiment of the invention includes two ignition portals 225 disposed on opposite ends of the second portion 220 of the housing 200. Each ignition portal 225 may have a corresponding ignition device or ignition pellet 230 disposed within the ignition portal 225. Each ignition portal 225 may also have a corresponding top first portion aperture 215 that allows conflagrant communication (relating to fire, combustion, ignition, and the like) between the ignition pellet 230 and flare grain 510. Each ignition portal 225 may also have a corresponding second portion aperture that allows conflagrant communication between the ignition pellet 230 and the impulse cartridge(s) 505.

The first portion 210 of the housing 200 may have a top first portion 212, a hollow bottom first portion 213, and a side first portion 214. As seen in FIGS. 1–4, the second portion 220 of the housing 200 may correspond and communicate to the hollow bottom first portion 213 of the first portion 210 of the housing 200, and the side first portion 214 may envelop or overlap the second portion 220. The side first portion 214 may be substantially elliptical or substantially oval and is typically the same shape as the second portion 220 of the housing 200 and the cross section of the aft portion 501 of the flare 500. The housing 200 may also include apertures 211. The apertures 211 may be located on opposite ends of the side first portion 214 of the housing to accommodate the slider assembly 300. As seen in FIG. 1, on the first portion 210 of the housing there may be a top plate 403 and a stem cylinder 404 to attach the igniter 10 to the flare grain 510.

The slider assembly 300 can be disposed within the housing 200 between the first portion 210 and the second portion 220. The slider assembly 300 may have an armed position and a safe position. The armed position does not cover the ignition portal(s) 225 and allows conflagrant communication between the ignition pellets 230 and flare grain 510, while the safe position covers the ignition portal (s) 225 and does not allow conflagrant communication between the ignition pellets 230 and flare grain 510. The preferred embodiment of the invention includes two sliders 305 for covering the two ignition portals 225. In the safe position the sliders 305 prevent conflagrant communication and provide a mechanical block between the ignition portals 225 and the flare grain 510.

Figure 4:
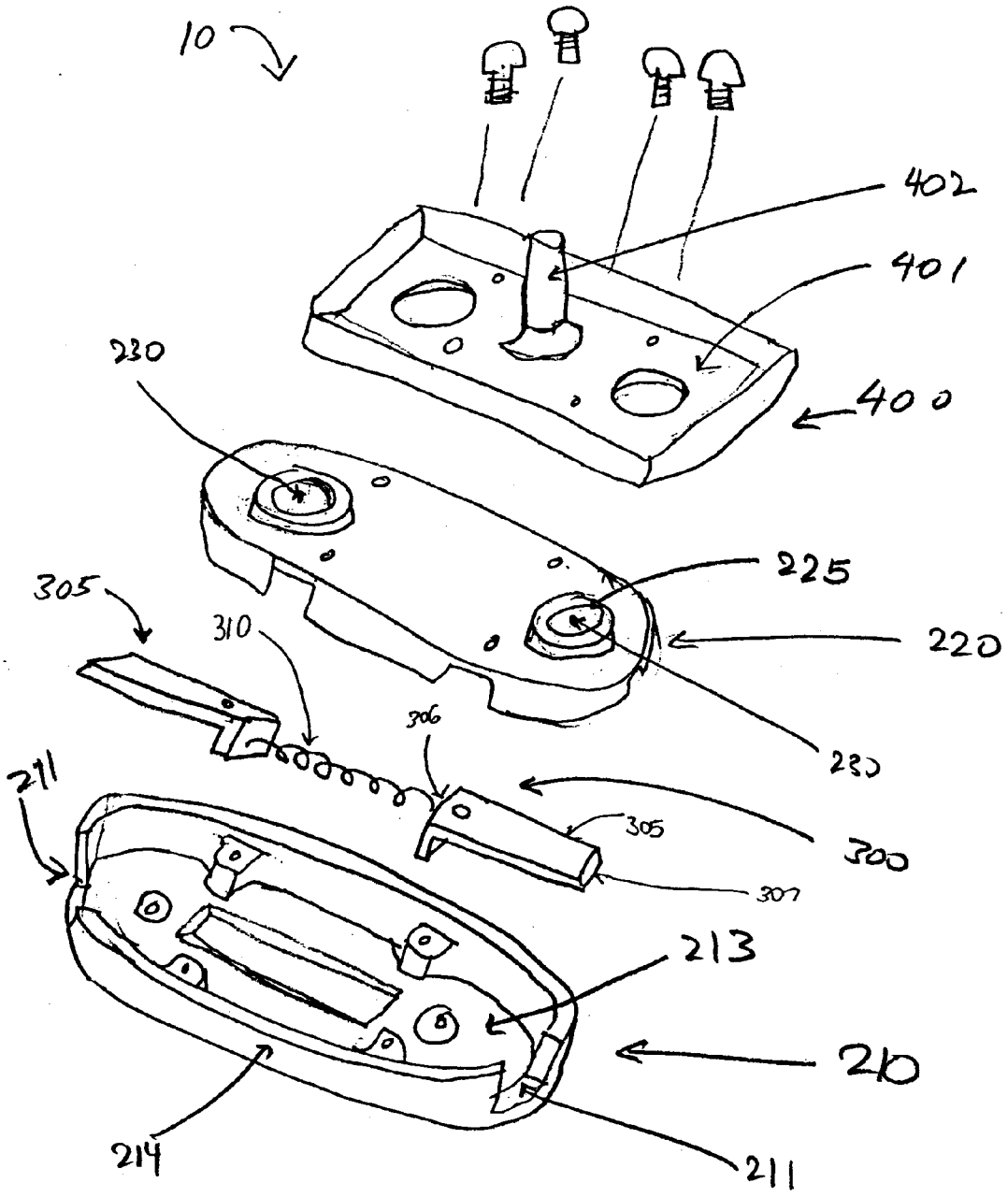
FIG. 4 is an exploded bottom view of one of the embodiments of the igniter system for a flare.

In the preferred embodiment, there is one slider 305 corresponding to each ignition portal 225. As seen in FIGS. 1 and 4, the two sliders 305 may be communicating via a spring 310. The sliders 305 may be disposed on opposing ends of the spring 310, and the sliders 305 and spring 310 may be axially aligned. The sliders 305 may be thin rectangular plates and substantially similar. The sliders 305 each may include a slider first end 306 and a slider second end 307. The slider first end 306 may have a slider lip 308. The slider lip 308 may be communicating with or be attached to the spring 310. As seen in FIGS. 1 and 4, the spring 310 may be a coaxial spring or a tensioned coil spring, and the sliders 305 may be disposed on opposite axial ends of the spring 310.

The piston assembly 400 communicates with the housing 200, specifically, the piston assembly 400 may be attached to the second portion 220 of the housing. The piston assembly 400 when activated can cause the slider assembly 300 to be in the armed position by pushing the igniter 10 away from the flare case 511. The ignition pellets 230 disposed within the ignition portal 225 are ignited by hot particles emanating from the impulse cartridge 505, and then the ignition pellets 230 ignite the flare 500. The piston assembly 400 may include a piston plate 401 and a piston cylinder 402. The piston plate 401 may be in communication with the bottom of the side first portion 214 and the bottom of the second portion 220 of the housing 200. The piston plate 401 may be substantially rectangular and overhang past the housing 200. The piston cylinder 402 may protrude perpendicularly from the piston plate 401 and may act as a standoff and assure proper spacing for the impulse cartridge 505. In another embodiment, which can be utilized on cylindrical flares, an o-ring groove on the housing 200 in conjunction with an o-ring can be used as the piston assembly 400.

Figure 5:
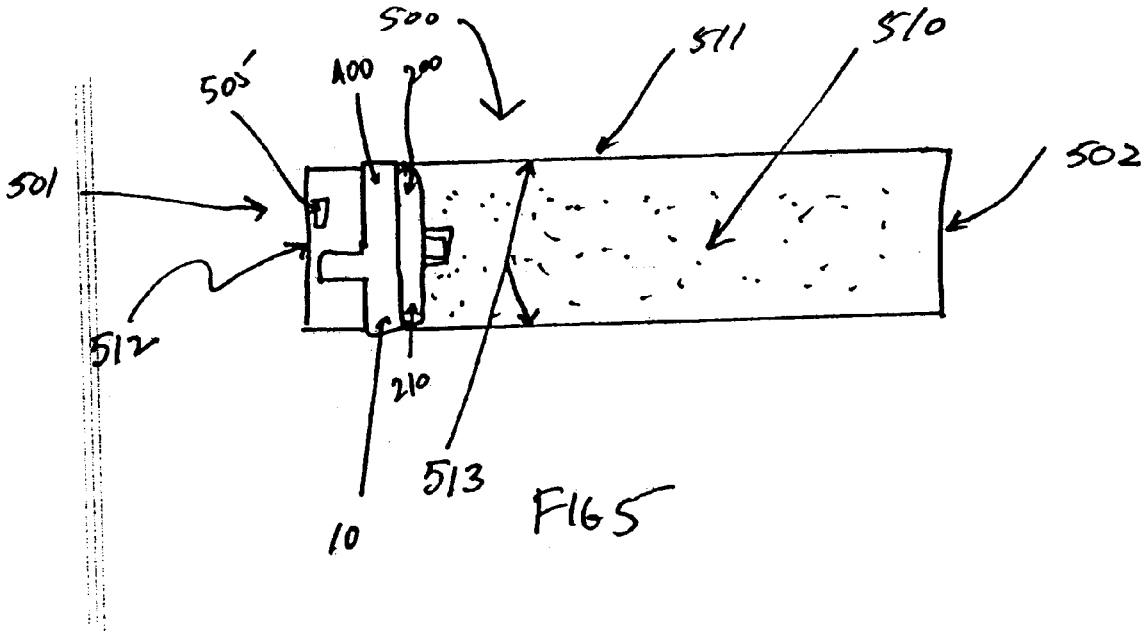
FIG. 5 is side view of a flare with an embodiment of the igniter system for a flare.

As seen in FIG. 5, the typical flare 500 includes a flare case 511, an aft end (rear) 501 and a fore end (front) 502. Flare grain 510 or the incendiary/pyrotechnic material used to illuminate a flare 500 is disposed within the flare case 511. The flare case 511 usually includes a flare case inner wall 513. The first portion 210 of the housing 200 may cross sectionally physically complement the flare case inner wall 513 at the aft end 501 of the flare 500. The flare case inner wall 513 and the first portion 210 may be a female-male connection with the flare inner case wall 513 acting as a sleeve (female) while the first portion 210 acting as an insert (male.) The first portion 210 may include apertures 211. As seen in FIGS. 1–4, the apertures 211 may correspond to the sliders 305 such that the sliders 305 can pass through the apertures 211. The slider second ends 307 can then press against the flare case inner wall 513, which tensions the spring 310, and equalizes the force on sides of the flare case inner wall 513. The igniter system for a flare 10 would then be in the safe position, as the sliders 305 cover the ignition portals 225. When the slider second ends 307 are not pressed against the flare inner case wall 513, and the spring 310 is not tensioned, the igniter system for a flare 10 is in the armed position, as the sliders 305 are pushed outwardly by spring tension force and no longer cover the ignition portals 225.

As seen in FIG. 1, the second portion 220 of the housing 200 may have a slider groove 221, which can accept the slider assembly 300. The slider groove 221 can secure the slider assembly 300 in the direction perpendicular to the axis of the slider assembly 300, and can prevent any rotational movement or biasing. The slider groove 221 is positioned such that the slider ends 307 correspond to the apertures 211 allowing the slider second ends 307 to pass through the apertures 211 and communicate with the flare case inner wall 513.

A flare 500 with the igniter system for a flare 10 attached is shown in FIG. 5. In operation, a flare 500 is dispensed from a flare dispenser using an impulse cartridge 505. The impulse cartridge 505 may be activated by percussion, an electrical current, or any other type of activation means or method. Upon activation of the impulse cartridge 505, the internal payload (the igniter system for a flare 10), which is typically located on the aft end 501 of the flare 500, begins to move from the flare case 511. As seen in FIG. 5, the impulse cartridge 505 is typically located behind the igniter system for a flare 10 and has a casing 512 sealing the impulse cartridge 505 into place. When the impulse cartridge 505 is activated, the hot particles from the impulse cartridge 505 travel through piston apertures 406 and the second portion apertures and ignite the ignition pellets 230. In the safe position the sliders 305 separate the ignition pellets 230 and flare grain 510 and press against the flare case inner wall 513. The gas pressure generated by the impulse cartridge 505 causes the piston assembly to push the igniter/grain assembly out of the flare case 511. When the igniter system for a flare 10 clears the flare case 511, the sliders 305 no longer press against the flare case inner wall 513, the spring 310 is no longer tensioned, and the sliders 305 are removed from between the ignition pellet 230 and flare grain 510 by the outward axial tension forces in the spring 310, allowing the flare grain 510 to be ignited by the ignition pellet 230 (which was just previously activated by the impulse cartridge 505.) In some instances, especially in kinematic flares, the flare 500 continues on its trajectory, while the igniter system for a flare 10 separates from flare 500 and falls away from the flare 500.

The first portion 210, the second portion 220 of the housing 200, and the piston assembly 400 may be attached to each other using any type of fastening system. The preferred embodiment utilizes assembly screws 500 that enter all three parts without constricting the motion of the slider assembly 300 in any way. The igniter system for a flare 10 may be manufactured from plastic or any other type of material that lends itself to a flare igniter application. The spring 310 may be manufactured from any type of metal, metal alloy, or any type of material that lends itself to spring manufacture.

When introducing elements of the present invention or the preferred embodiment(s) thereof, the articles "a," "an," "the," and "said" are intended to mean there are one or more of the elements. The terms "comprising," "including," and "having" are intended to be inclusive and mean that there may be additional elements other than the listed elements.

Although the present invention has been described in considerable detail with reference to certain preferred versions thereof, other versions are possible. Therefore, the spirit and scope of the appended claims should not be limited to the description of the preferred versions contained herein.

What is claimed is:

1. An igniter system for a flare, comprising:

(a) a housing, the housing comprising two ignition portals for holding ignition pellets;

(b) a slider assembly, the slider assembly disposed within the housing, the slider assembly comprising two sliders and a spring, each slider corresponding to an ignition portal, the two sliders attached to the spring, the slider assembly having an armed position and a safe position, the armed position with the sliders uncovering the ignition portals and allowing conflagrant communication between the ignition pellets and flare grain, the safe position with the sliders covering the ignition portals and not allowing conflagrant communication between the ignition pellets and flare grain; and (c) a piston assembly, the piston assembly attached to the housing, the piston assembly when activated can cause the slider assembly to be in the armed position.

2. The igniter system for a flare of claim 1, wherein the housing further comprising a first portion and a second portion, the second portion comprising two ignition portals for holding ignition pellets.

3. The igniter system for a flare of claim 2, wherein the two sliders are disposed on opposing ends of the spring.

4. The igniter system for a flare of claim 3, wherein the flare has a flare case inner wall, the first portion of the housing cross sectionally physically complements the flare case inner wall.

5. The igniter system for a flare of claim 4, wherein the first portion comprising corresponding apertures such that the sliders can pass through the apertures, press against the flare case inner wall, and equalize the force on sides of the flare case inner wall when in the safe position.

6. The igniter system for a flare of claim 5, wherein the second portion comprising a slider groove, the slider groove being able to accept the slider assembly.

7. The igniter system for a flare of claim 6, wherein the slider groove prevents any rotational movement of the slider assembly.

8. The igniter system for a flare of claim 7, wherein the piston assembly physically communicates with the second portion of the housing.

9. The igniter system for a flare of claim 8, wherein the piston assembly is activated by impulse cartridges.

10. The igniter system for a flare of claim 9, wherein the ignition pellets are ignitable by impulse cartridges.

11. An igniter system for a flare, comprising:

(a) a housing, the housing comprising a first portion and a second portion; the second portion having two ignition portals, the flare having a flare case inner wall, the first portion of the housing cross sectionally physically complementing the flare case inner wall;

(b) a slider assembly, the slider assembly disposed within the housing between the first portion and the second portion, the slider assembly comprising two sliders and a spring, the two sliders disposed on opposing ends of the spring, each slider corresponding to an ignition portal, the slider assembly having an armed position and a safe position, the armed position with sliders uncovering the ignition portals and allowing conflagrant communication between the ignition pellets and flare grain, the safe position with sliders covering the ignition portal and not allowing conflagrant communication between the ignition pellets and flare grain, the second portion of the housing comprising a slider groove, the slider groove being able to accept the slider assembly wherein the slider groove prevents any rotational movement of the slider assembly, the first portion comprising corresponding apertures such that the sliders can pass through the apertures, press against the flare case inner wall, tension the spring, and equalize the force on sides of the flare case inner wall when in the safe position and be in the armed position when the sliders do not communicate with the flare case inner wall and the spring is not fully tensioned; and (c) a piston assembly, the piston assembly attached to the housing, the piston assembly when activated can cause the slider assembly to be in the armed position and the ignition pellets disposed within the ignition portal being ignitable such that the ignition pellets can ignite the flare, the piston assembly activatable by impulse cartridges.

12. The igniter system for a flare of claim 11, wherein the two sliders and the spring are axially aligned.

13. The igniter system for a flare of claim 12, wherein the ignition pellets activatable by impulse cartridges, and the ignition pellets ignitable by impulse cartridges.

14. The igniter system for a flare of claim 13, wherein upon activation the piston assembly causes the igniter system for a flare to eject from the flare, causing the slider assembly to be in the armed position.

15. The igniter system for a flare of claim 14, wherein the first portion of the housing, the second portion of the housing and the piston assembly are attached to each other using a fastener.

16. The igniter system for a flare of claim 15, wherein the flare case inner wall and the first portion of the housing are a male-female connection with the inner case wall acting as a sleeve(female) and the first portion acting as an insert (male).

* * * * *

UNITED STATES PATENT AND TRADEMARK OFFICE

CERTIFICATE OF CORRECTION

PATENT NO. : 6,588,343 B1
DATED : July 8, 2003
INVENTOR(S) : David J. Mulinix

It is certified that error appears in the above-identified patent and that said Letters Patent is hereby corrected as shown below:

Column 2,
Line 36, should read -- to the armed position. The ignition pellets, ignited by hot --

Signed and Sealed this

Twenty-third Day of September, 2003

JAMES E. ROGAN
*Director of the United States Patent and Trademark Office*